United States Patent [19]

Feldt

[11] Patent Number: 4,682,376

[45] **Date of Patent: * Jul. 28, 1987**

[54] DELIVERY BED

[75] Inventor: Mats Feldt, Liatorp, Sweden

[73] Assignee: Landstingens Inkopscentral Lic, Ekonomisk Forening, Solna, Sweden

[ * ] Notice: The portion of the term of this patent subsequent to Oct. 7, 2003 has been disclaimed.

[21] Appl. No.: 893,684

[22] Filed: Aug. 6, 1986

Related U.S. Application Data

[62] Division of Ser. No. 786,284, Oct. 10, 1985, Pat. No. 4,615,058.

[30] Foreign Application Priority Data

Oct. 10, 1985 [SE] Sweden ..... 8500388

[51] Int. Cl.[4] ..... A61G 7/00

[52] U.S. Cl. ..... 5/60; 5/181

[58] Field of Search ..... 5/60, 63, 69, 67, 66, 5/80, 181, 184, 62, 202

[56] References Cited

U.S. PATENT DOCUMENTS 4,615,058 10/1986 Feldt ..... 5/60

*Primary Examiner*—John E. Murtagh

*Attorney, Agent, or Firm*—Young & Thompson

[57] ABSTRACT

A delivery bed has a seat part supported on raisable and lowerable side-pieces. A leg-support has side tubes which are journalled for axial movement on forwardly and rearwardly located pairs of support rollers journalled on bolts attached to the side-pieces. Mounted on the side-pieces are guide bars which present along the bottom edge surfaces thereof a plurality of circle-segmental latching recesses intended to co-act with circular latching flanges on the rearwardly located support rollers in selected latching positions. The position of the leg-support is adjusted by lifting the support and axially moving the same to a desired latching position.

1 Claim, 7 Drawing Figures

DELIVERY BED

This application is a division of application Ser. No. 786,284, filed Oct. 10, 1985, now U.S. Pat. No. 4,615,058.

The present invention relates to a delivery bed of the kind which comprises an overlying bed structure which can be adjusted to a number of mutually different positions, and an undercarriage on which means are provided for supporting the overlying bed structure and adjusting said structure to a desired height.

The overlying bed structure comprises a centre part, or seat part, and a back rest which can be raised relative to the seat part. Slidably arranged beneath the seat part is an elongated, plate-like leg-support which can be drawn out to varying extents, between a fully inserted position and a fully extended position, therewith to form in the main an extension of the seat part.

The overlying bed structure has the form of a steel frame which incorporates side-pieces, and the leg-support has the form of a rigid tubular structure, which incorporates side-members and cross-stays which interconnect said side-members.

Known delivery beds provided with an extensible leg-support comprise a relatively large number of structural components and bed manipulating means, which add commensurately to the cost of manufacturing the bed and which also make the bed more difficult to clean, when washing the same after use. In certain cases the bed incorporates movable components which need to be lubricated from time to time, and also manually operated devices for releasing the leg-support and locking the same in its adjusted position.

Against this background, the object of the invention is to provide greatly simplified means for adjusting the leg-support to different extended positions, while enabling the leg-support to be moved to and locked in the position to which it is adjusted without needing to manipulate a particular knob or lever.

This object is achieved with a delivery bed constructed in accordance with the invention and having the characteristic features set forth in the following claims.

The leg-support of the delivery bed according to the present invention can thus be adjusted to and locked in a plurality of selected positions, which correspond to those positions which might be required. The leg-support is released quite simply, by grasping the same and lifting the outwardly end thereof in a manner to move the latching recess out of engagement with the rearwardly located support rollers. The leg-support can then be slid comfortably inwardly or outwardly until reaching the position desired, whereupon the leg-support is dropped, so as to bring a latching recess into engagement with the support rollers and therewith lock the leg-support against axial movement.

These and other characteristic features of the invention will be described more clearly hereinafter with reference to an exemplary embodiment of a delivery bed according to the invention illustrated in the drawings.

Figure 1:
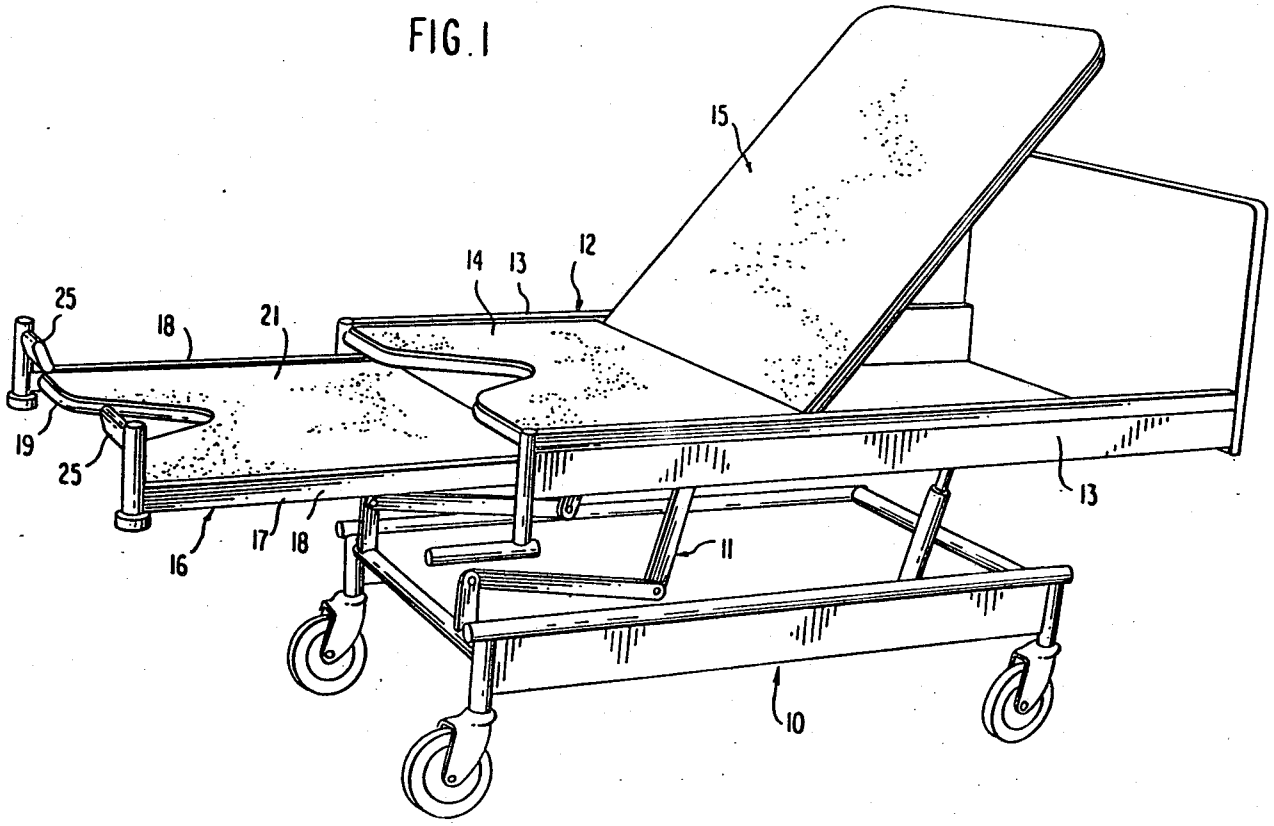
FIG. 1 illustrates schematically and in perspective a delivery bed according to the invention, and shows the back-rest in a raised position and the leg-support extended.

The undercarriage 10 of the bed may be of conventional construction, incorporating means 11 for supporting the frame of the overlying bed structure in and adjusting said frame to different heights and angular positions. The two side-pieces of the over-lying bed structure support a seat part 14 and a back-rest 15 which can be raised in relation to the seat part. Slidably arranged beneath the seat part is a leg-support 16.

Figure 2:
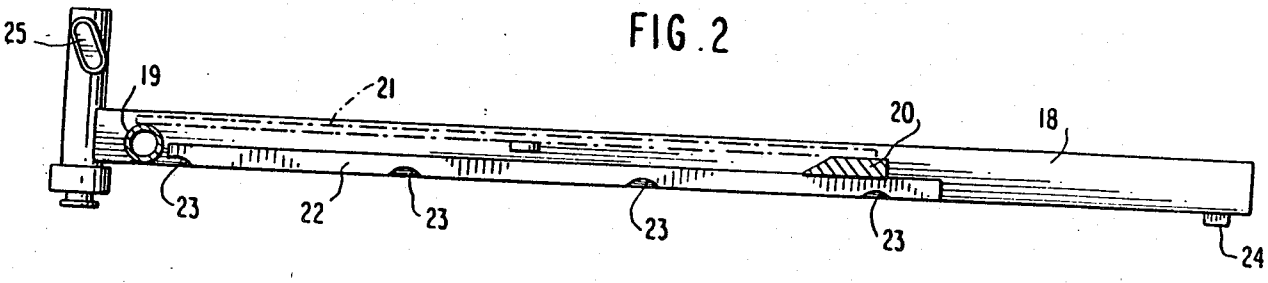
FIG. 2 is a sectional, schematic side-view of the tubing of the leg-support, this section being taken on the line 2—2 in FIG. 3.
Figure 3:
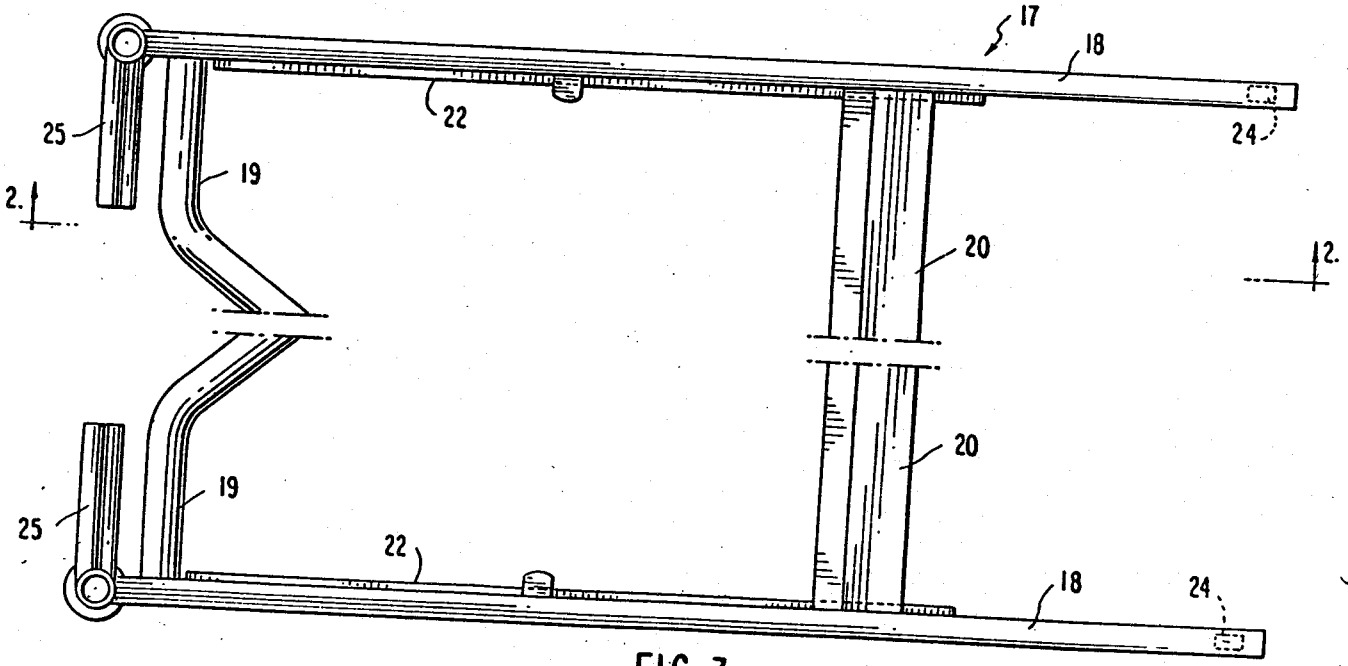
FIG. 3 illustrates the leg-support as seen from above.
Figure 6:
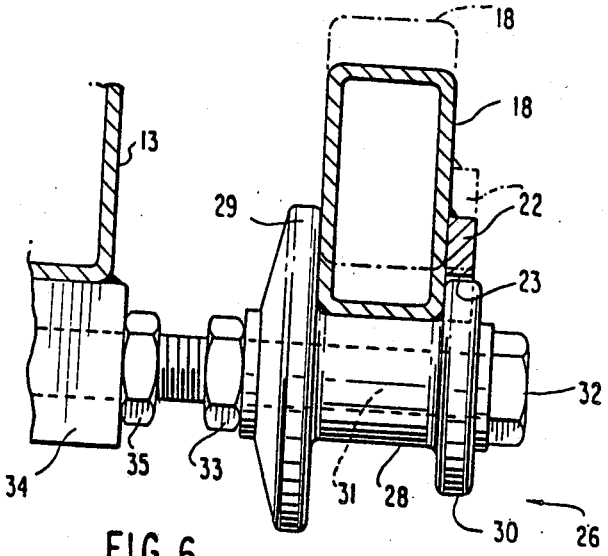
FIG. 6 is a detailed view of one rearwardly located support roller and illustrates a side-piece of the leg-support and its guide bar in a locked position, and in broken lines in an elevated position, said side-piece being shown in section.
Figure 7:
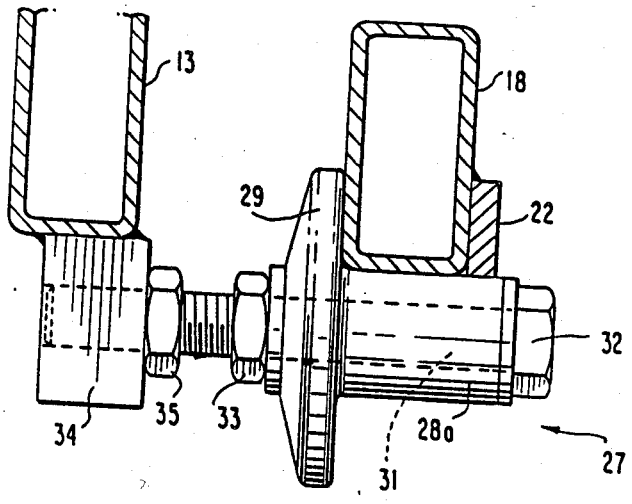
FIG. 7 is a detail view of one forwardly located support roller.

As illustrated in FIGS. 2 and 3, the leg-support 16 comprises a frame 17 which incorporates two side tubes 18 interconnected by cross-stays 19, 20. As shown in FIGS. 6 and 7, the side tubes are of rectangular cross-section. A plate 21 (FIG. 1) rests on the frame.

Welded on the inner surfaces of the side tubes are guide bars 22, the lower edge surfaces of which lie substantially edge-to- edge with the bottom edges of the guide bars.

Located in the bottom edge surface of the guide bars are circle-segmental recesses 23, which are operative in latching the leg-support in its various extended positions and in its fully inserted position, as described hereinafter.

A stop shoulder 24 defines the maximum limit to which the leg-support can be extended.

Two handles 25 are provided on the rearwardly located end of the leg support, for maneuvering said support.

Figure 4:
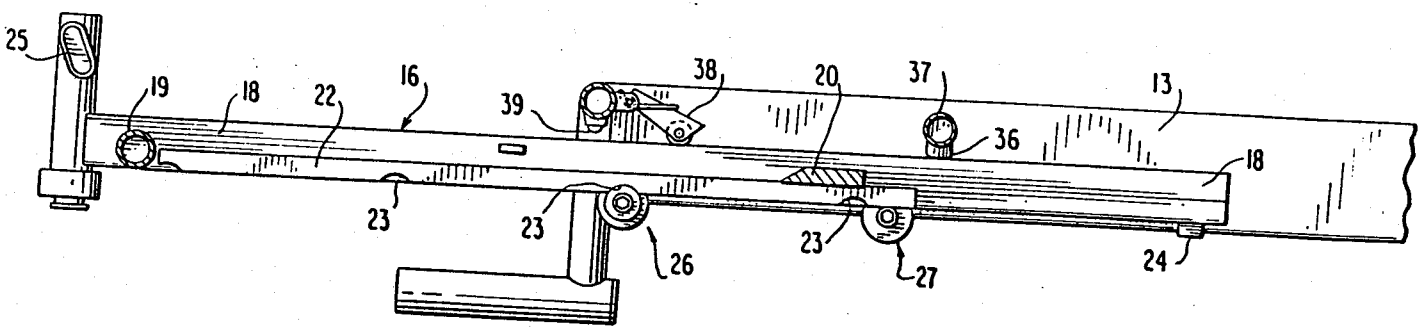
FIG. 4 is a schematic sectional view taken on the line 4—4 in FIG. 5, and illustrates the leg-support and a side-piece.
Figure 5:
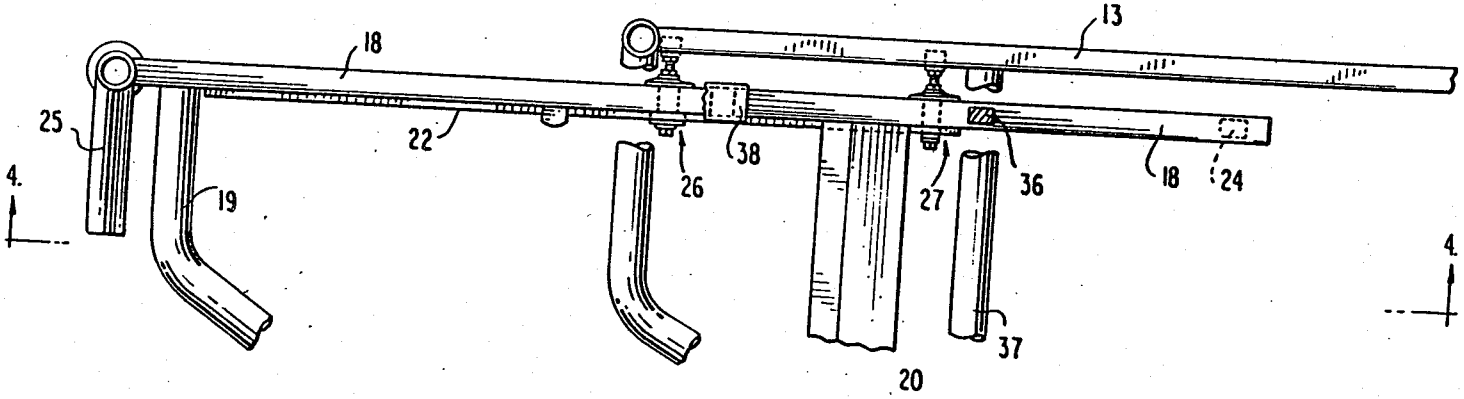
FIG. 5 illustrates a side part of the leg-support and a side-piece from above.

As illustrated in FIGS. 4 and 5, the side-pieces 13 have mounted thereon a rearwardly located pair of support rollers 26 and a forwardly located pair of support rollers 27. Only one support roller of each pair is illustrated in FIG. 5.

The rearwardly located support roller shown in FIG. 6 has a cylindrical part 28, which forms a support for the side tube 18 in given positions. The support roller is provided on its outer end with a guide flange 29, which forms a lateral guide for the side tube 18 in all positions.

The support roller is provided on its inner end with a circular latching flange 30, which is intended to engage a respective latching recess 23 on the guide bar 22.

FIG. 6 illustrates in full lines a latched position in which the tube 18 rests on the cylindrical part 28 and the flange 30 lies in one of the recesses 23, so as to latch the leg-support.

A bolt 31 forms a journal shaft for the support roller 26, which lies between the bolt head 32 and a lock nut 33, which is located to hold the support roller in a manner which excludes axial play laterally on the bolt.

The bolt 32 is screwed into a bolt attachment 34, which is welded to the bottom edge of the side-piece 13. The lateral position of the support roller can be readily adjusted, by simply screwing the bolt in or out. The bolt is then locked in position by means of a lock nut 35. The forward support roller 27 illustrated in FIG. 7 is substantially similar to the roller 26, but with the difference that the flange 30 is omitted on the forward roller, so that the cylindrical part 28a extends right to the end of the roller.

When occupying the latched position illustrated in FIG. 4, a load can be exerted on the leg-support 16, which will then rest on the rearwardly located rollers 26. At the same time, the upper sides of the tubes 18 rest against a support shoulder 36 welded to a cross-section stay 37 extending between the side-pieces 13. The shoulder 36 is located somewhat forwardly of the roller 27, as illustrated in FIG. 4.

In order to safeguard the latched position still further, a spring-loaded holding means 38 is located on each side-piece and adapted to exert a spring force on respective side tubes at a location somewhat forwardly of respective rollers 26.

The leg-support 16 is adjusted to a desired position quite simply by standing on one or the other side of the leg-support and grasping the one handle 25 with one hand and lifting the leg-support so that the latching flanges 30 of the rearwardly located rollers move out of engagement with respective latching recesses. In this position the tubes 18 are still guided by the flanges 29 on the two rollers. The extent to which the leg-support can be lifted is restricted by slide shoulders 39.

The leg-support can then be pushed-in or drawn-out quickly and comfortably, to a position in which the selected latching recesses 23 are able to pass into full latching engagement with the latching flanges of the rearwardly located rollers 26.

The leg-support will lie relatively firmly beneath the seat part, and the underside of the leg-support is devoid of all bulky manipulating devices capable of restricting the possibility of lowering the overlying bed structure to a relatively low height above the floor. This enables the bed to be adjusted to a position in which the patient can readily climb into the bed or leave the bed from one side thereof.

I claim:

1. A delivery bed having a raisable and lowerable overlying bed structure and side-pieces for supporting a seat part and a raisable back-rest, and further including a frame structure which can be slidably moved lengthwise of the bed relative to the seat part and which incorporates an elongated plate-like element intended to form a leg-support capable of being extended from an inwardly inserted position to a plurality of extended positions, said frame having mounted thereon a support roller rotatable about a horizontal axis perpendicular to the length of the bed, and means on said frame structure defining a plurality of downwardly opening recesses, said recesses being spaced apart in a direction lengthwise of the bed and being selectively individually engageable over said roller in said plurality of extended positions thereby to support said frame structure in a selected one of said positions against sliding movement lengthwise of said frame, said frame structure being raisable and lowerable relative to said roller to an extent such that when raised, the frame structure can slide lengthwise of the bed with said roller out of engagement with all of said recesses, and when lowered can roll on said roller until said roller enters one of said recesses.

* * * * *